US005469825A

United States Patent [19]

Golab et al.

[11] Patent Number: 5,469,825

[45] Date of Patent: Nov. 28, 1995

[54] FUEL INJECTOR FAILURE DETECTION CIRCUIT

[75] Inventors: Pawel J. Golab, Birmingham; Anson Lee, St. Clair, both of Mich.

[73] Assignee: Chrysler Corporation, Highland Park, Mich.

[21] Appl. No.: 308,226

[22] Filed: Sep. 19, 1994

[51] Int. Cl.[6] ..... F02D 41/22; F02D 41/30; H01H 47/32

[52] U.S. Cl. ..... 123/479; 123/481; 123/490; 361/154

[58] Field of Search ..... 123/478, 480, 123/479, 481, 490, 491; 361/152, 154; 73/119 A

[56] References Cited

U.S. PATENT DOCUMENTS

| | | | |
|---|---|---|---|
| 3,646,915 | 3/1972 | Rachel | 123/491 |
| 3,646,917 | 3/1972 | Nagy | 123/491 |
| 3,646,918 | 3/1972 | Nagy et al. | 123/491 |
| 4,337,650 | 7/1982 | Brandt | 73/119 A |
| 4,437,342 | 3/1984 | Hosaka et al. | 73/119 A |
| 4,589,401 | 5/1986 | Karim et al. | 123/479 |
| 4,611,565 | 9/1986 | Yakuwa | 123/479 |
| 4,618,908 | 10/1986 | Anttila | 123/490 |
| 4,680,667 | 7/1987 | Petrie | 123/490 |
| 4,683,859 | 8/1987 | Tamura et al. | 123/491 |
| 4,696,275 | 9/1987 | Kushi et al. | 123/478 |
| 4,736,267 | 4/1988 | Karlmann et al. | 361/101 |
| 4,753,207 | 6/1988 | Wright | 123/490 |
| 4,766,864 | 8/1988 | Ban et al. | 123/357 |
| 4,798,084 | 1/1989 | Takahashi et al. | 73/119 A |
| 4,979,481 | 12/1990 | Shimomura et al. | 123/481 |
| 4,982,331 | 1/1991 | Miyazaki | 364/431.04 |
| 4,989,150 | 1/1991 | Tazawa | 364/431.03 |
| 5,046,470 | 9/1991 | Entenmann et al. | 123/481 |
| 5,053,911 | 10/1991 | Kopec et al. | 123/490 |
| 5,172,588 | 12/1992 | Umemoto | 73/119 A |
| 5,173,832 | 12/1992 | Giorgetta et al. | 361/88 |
| 5,176,122 | 1/1993 | Ito | 123/478 |
| 5,181,493 | 1/1993 | Motoyama et al. | 123/431 |
| 5,196,833 | 2/1993 | Kemp | 340/663 |
| 5,241,933 | 9/1993 | Morikawa | 123/198 D |

*Primary Examiner*—Willis R. Wolfe
*Attorney, Agent, or Firm*—Mark P. Calcaterra

[57] ABSTRACT

In a engine and associated fuel injector failure detection circuit, the engine having at least one combustion chamber, a battery, and at least one fuel injector having a high side and a low side terminal for introducing a fuel in the at least one combustion chamber, the fuel injector failure detection circuit comprising a one shot timer for transmitting a constant voltage state signal output when the fuel injector reaches a set current threshold at a start of an injector current peak time duration. A voltage sense comparator is provided for transmitting a low voltage state signal output when the low side terminal of the fuel injector produces a fly-back voltage pulse. A mechanism for monitoring current of the fuel injector during a rise time duration and the peak time duration ia also included. The circuit further provides a mechanism for disconnecting all electrical power supplied to the at least one fuel injector if the injector current fails to reach a peak level during the rise time duration or the fly-back voltage pulse fails to occur at the end of the peak time duration. Moreover, a mechanism for monitoring the fly-back voltage pulse produced by the low side terminal of the fuel injector is also included in the circuit.

15 Claims, 2 Drawing Sheets

FUEL INJECTOR FAILURE DETECTION CIRCUIT

BACKGROUND OF THE INVENTION

1. Field of the Invention

The present invention relates generally to the art of injectors. In particular, the present invention relates to a circuit for detecting failure of a fuel injector in varying states.

2. Description of the Related Art

It is known in the art of internal combustion engines that the introduction of fuel into a combustion chamber, timed in conjunction with spark plug and valve operations, can increase engine torque output. The increased torque output will result in greater power output performance of the engine. If, however, a fuel injector does not introduce fuel into the combustion chamber because of an internal failure or stays in an "on" position, engine performance can be affected. Various fuel injector failure detection circuits have accordingly been used to prevent injector operation given electrical fault or an internal injector anomaly.

Typical fuel injector failure detection circuits provide an output transistor in series connection with a solenoid fuel injector (hereinafter "fuel injector") and a current sensing resistor. In such systems a current limit controller is used to implement current control between set limits of the current flowing through the solenoid coil and output transistor. However, short circuits to ground may occur at the terminal ends of the fuel injector. This type of event can result in the sensing resistor reading that a low or zero current is flowing through the power output device and fuel injector.

Other inventions have tried to remedy the above problems by providing a fault detection circuit which can sense short circuits at either end terminal of the fuel injector. However, such inventions require the use of separate voltage comparators to monitor the voltage at each end terminal. In addition, these inventions only have the ability to detect when the terminal ends of the fuel injector are shorted to ground.

Still other inventions, which can detect the presence of a short or open circuited fuel injector, require the input of a camshaft or crankshaft sensor to determine whether the fault detection circuit has been "on" or "off" for a preselected number of degrees. Moreover, such inventions fail to read the fuel injector current at its peak rise time. This prevents early disabling of the fuel injector given a possible fault situation. In addition, such circuits do not detect a fly-back injector voltage at the end of an injector current peak time which denotes normal operation of the fuel injector.

SUMMARY OF THE INVENTION

In light of such desirable characteristics, not fully present in the related art, the present invention provides a fuel injector failure detection circuit which provides such desirable characteristics.

The present invention relates to a engine and associated fuel injector failure detection circuit, the engine having at lest one combustion chamber, a battery, and at lest one fuel injector having a high side and a low side terminal for introducing a fuel in the at least one combustion chamber. The fuel injector failure detection circuit comprising a one shot timer for transmitting a constant voltage state signal output when the fuel injector reaches a set current threshold at a start of an injector current peak time duration. A voltage sense comparator is provided for maintaining a required current wave form when the injector is being energized.

A means is also provided for monitoring current of the fuel injector during a rise time duration and the peak time duration is also included. The circuit further provides a means for disconnecting all electrical power supplied to the at least one fuel injector if the injector current fails to reach a peak level during the rise time duration or the fly-back voltage pulse fails to occur at the end of the peak time duration. Moreover, a means for monitoring the fly-back voltage pulse produced on the low side terminal of the fuel injector is also included in the circuit.

One advantage of the present invention is a fuel injection fault detection circuit is provided which expediently disconnects power the fuel injector if it shorts to ground, shorts to battery, or shorts internally.

A further advantage of the fuel injection fault detection circuit is that power is disconnected to the injector if it is open circuited or there is a change of impedance internal to the injector.

Moreover, the present invention reads the injector current at its peak rise time to provide for the early disabling of the injector given a possible fault situation.

A still further advantage is that the present invention detects a fly-back injector voltage at the end of the injector current peak time which denotes normal operation of the fuel injector.

An additional advantage of the injector fault detection circuit is that the use of separate voltage comparators to monitor the voltage at each end terminal is not required to detect when either terminal of the injector solenoid coil is shorted.

Other objects, features and advantages of the present invention will become apparent by reference to the following detailed description when considered in conjunction with the accompanying drawings.

BRIEF DESCRIPTION OF THE DRAWINGS

In the drawings below, reference characters refer to like parts throughout the views, and wherein.

DESCRIPTION OF THE PREFERRED EMBODIMENT(S)

Figure 1:
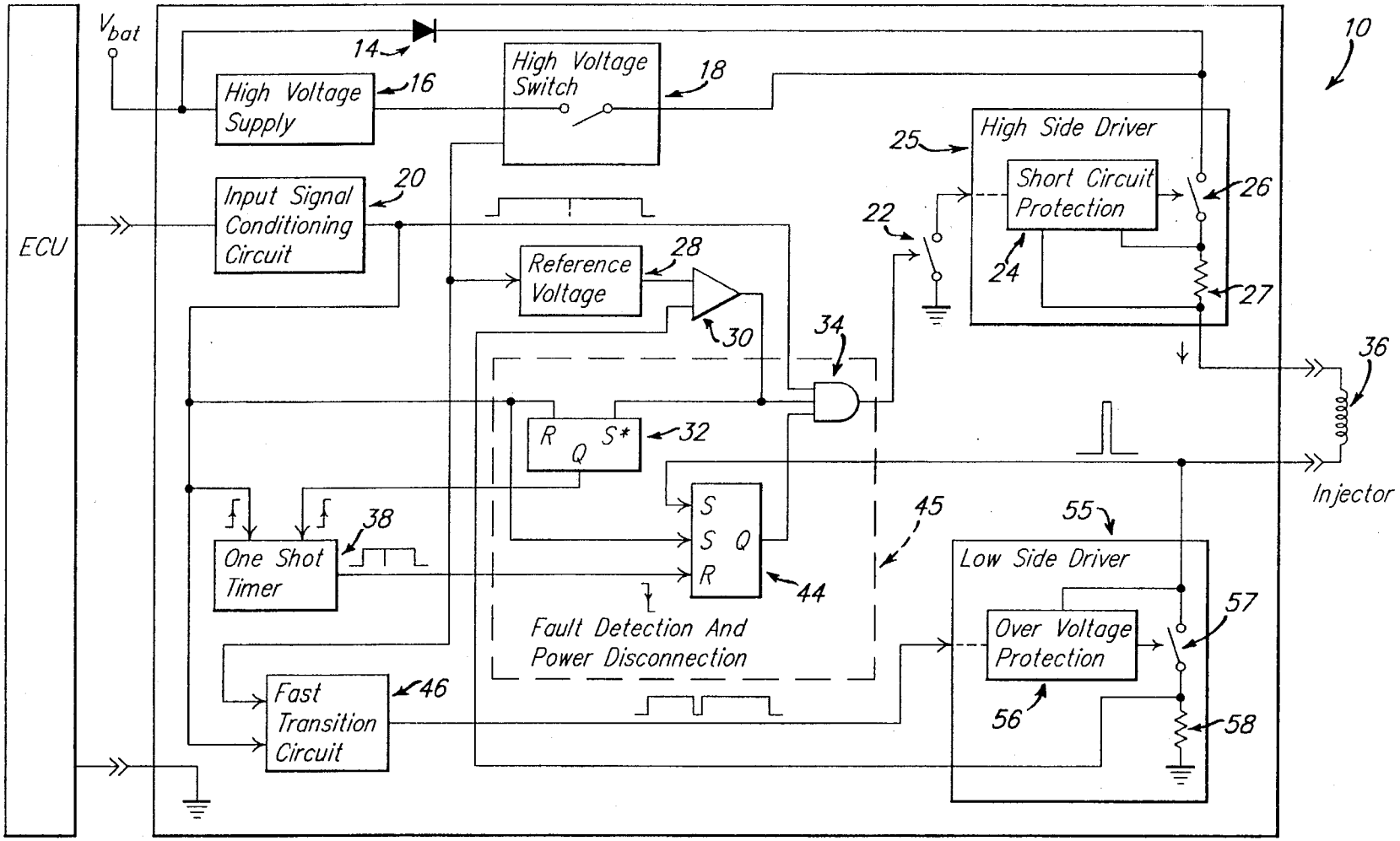
FIG. 1 is a block diagram view of a fuel injector and failure detection circuit of the present invention.

Referring now to the drawings and, in particular to FIG. 1, a fuel injector and failure detection circuit 10 is shown. Means are provided for supplying an enabling signal to the circuit 10 to start circuit operation. In the preferred embodiment, an engine controller or Electronic Control Unit (ECU) 12 is used to supply the enabling signal. The ECU 12 includes a microprocessor, memory (volatile and non-volatile), bus lines (address, control, and data), and other hardware and software needed to perform the task of engine control. The circuit 10 further includes an input circuit 20 in communication with the ECU 12 at a circuit input. A Vbat voltage signal from the vehicle battery is fed to the circuit 10 into an input of a high voltage power supply 16. The high voltage power supply input in communication with the anode of diode 14. The cathode of diode 14 in communication with a voltage switch 26 of a high side driver 25.

An output of high voltage power supply 16 is fed to an input of a high voltage switch 18. The output of high voltage switch 18 is fed to switch 26 internal to the high side driver 25. Referring to input circuit 20, the output is fed to a logic circuit having a functional equivalent output of an AND gate. In the preferred embodiment a three-input AND gate 34 is implemented. The output of circuit 20 is also in communication with the reset input (R) of edge triggered latch 32, an input of one shot timer 38, a set input (S) of latch 44 internal to fault detection and injector power disconnection circuit 45, and an input of a fast transition circuit 46.

A second input of the one shot timer 38 is in communication with the output of edge triggered latch 32. An output of one shot timer 38 is in communication with a reset input (R) of edge triggerable latch 44, internal to fault detection and injector power disconnection circuit 45. The output of one shot timer 38 is also in communication with an input of high voltage switch 18. The one shot timer output is also fed to an input of reference voltage 28 and to an input of fast transition circuit 46. The output of reference voltage 28 is fed into a positive input of voltage comparator 30. The negative input of voltage comparator 30 is in communication with switch 57 and sense resistor 58 which are both internal to low side driver 55.

Referring back to voltage comparator 30, the output is fed into the set prime input (S*) of latch 32 and an input of the functional equivalent of an AND gate 34. The output of latch 44 is also fed into the functional equivalent of an AND gate 34. While an S input of latch 44 is supplied by low side driver 55. The reset input (R) of latch 44 is fed by an output of the one shot timer 38. The output of the functional equivalent of an AND gate 34 is fed into an input of switch 22.

One terminal of switch 22 is connected to ground and the output is in communication with short circuit protection 24 of high side driver 25. The short circuit protection 24 is also in communication with switch 26 internal to the high side driver 25. The short circuit protection 24 is also in communication with both terminals of resistor 27. One terminal of resistor 27 in communication with switch 26. A second terminal of resistor 27 in communication with a high side terminal of fuel injector 36. The low side terminal of fuel injector 36 in communication with an input of latch 44, short circuit protection 56, and switch 57 internal to low side driver 55. The short circuit protection 56, internal to low side driver 55, in communication with an input of switch 57. Switch 57 also in communication with a first side of resistor 58. A second side of resistor 58 connected to ground. It is appreciated that switches 18, 22, 26, 57 could be funtionally equivalent bi-polar or MOSFET transistors.

Figure 2:
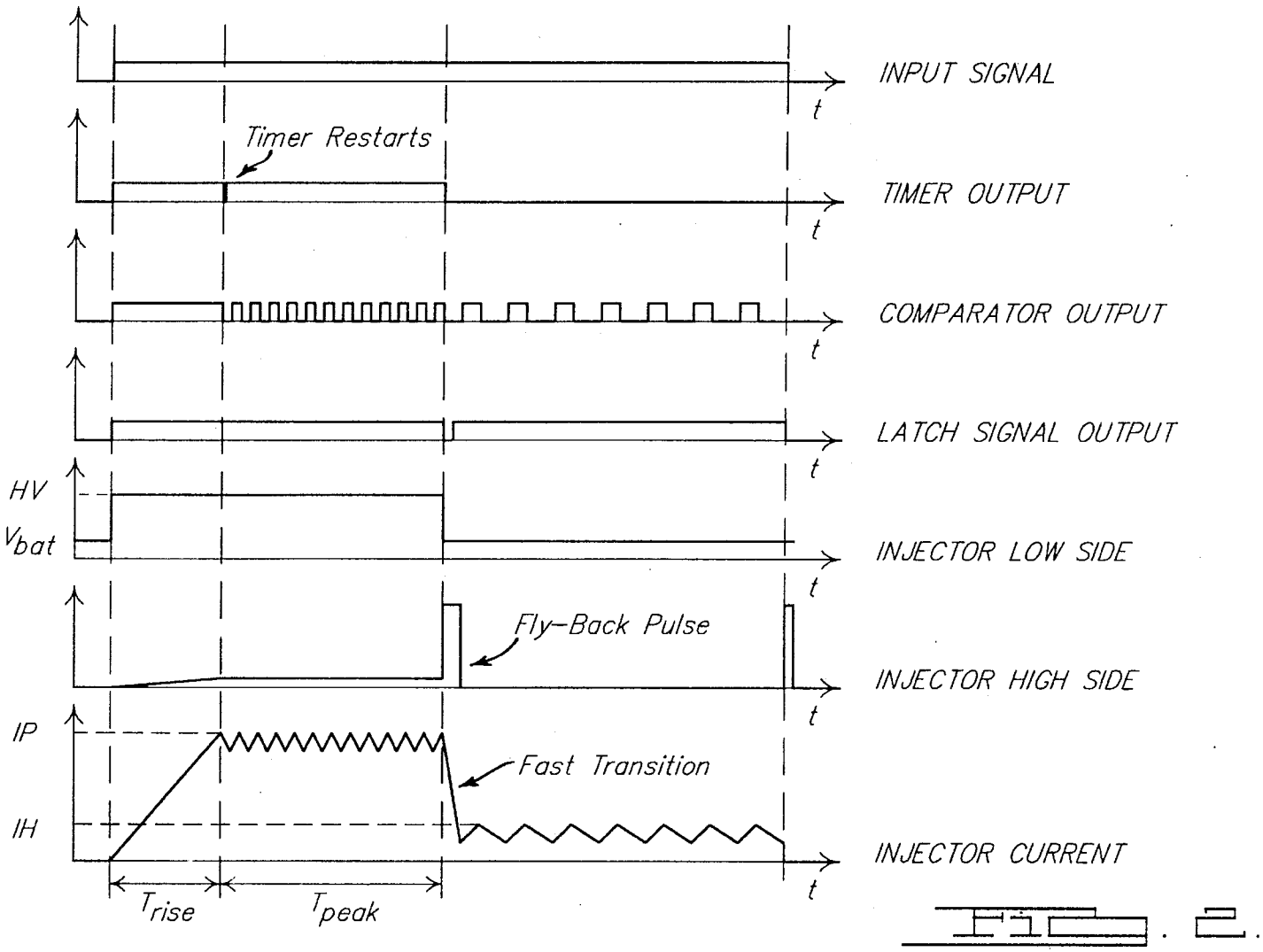
FIG. 2 is a timing diagram of a signal representation of various component characteristics of the fuel injector and failure detection circuit of the present invention.

The operation of the injector driver failure detection circuit 10 is as follows. Referring to the circuit schematic of FIG. 1, a pulse is sent from ECU 12 to input circuit 20. The rising edge of the output pulse from input circuit 20 starts the one shot timer 38 as is shown in FIG. 2. The rising edge of the output from input circuit 20 also resets the edge triggerable latch 32 and sets edge triggerable latch 44. The one shot timer 38 activates high voltage switch 18 and further sets the high reference voltage 28 which is fed into the high side input of voltage comparator 30. In addition, the high side driver 25 and low side driver 55 are also placed in an activated state. Such an occurrence causes the current of fuel injector 36 to start rising, as is shown in FIG. 2. It is appreciated that the injector failure detection circuit 10 provides means for protecting both the high side and low side sides of injector 36. While the present embodiment uses high and low side drivers, it is to be understood that other circuitry or circuit components could also be used such as high voltage diodes.

The injector failure detection circuit 10 provides means for monitoring injector current during time durations Trise and Tpeak. In the preferred embodiment, when the current reaches a desired peak level after time duration Trise, edge triggerable latch 32 is set and one shot timer 38 resets. The one shot timer 38 remains activated for a time duration equal to Tpeak. The high voltage power supply 16, which boosts the voltage of the vehicle battery (Vbat), remains activated for the duration of Trise and Tpeak. Next, the high voltage switch 18 is deactivated by the one shot timer output and the fast transition circuit 46 is activated. The reference voltage 28 then changes values. Edge triggerable latch 44 is also reset by the output of one shot timer 46. A rising voltage on the low side terminal of fuel injector 36 is then sensed by the input of latch 44. The edge triggerable latch 44 is then set again. The fuel injector driver failure detection circuit 10 then continues operation at a low voltage level (battery voltage).

The fuel injector driver failure detection circuit 10 detects a number of possible fault situations such as the injector shorting to ground, injector shorting to battery, injector open circuited, injector shorted internally, and a change of injector impedance. It has come to be know that a change of injector impedance could occur from such things as a bad connection, short to an vehicle load, or other injector anomalies. The aforementioned failures all change the time needed to reach the desired injector current peak level, designated as IP in FIG. 2, or may cause a lack of fly-back voltage pulse at the end of time duration Tpeak.

The present circuit 10 provides means for disconnecting all electrical power supplied to the fuel injector 36. In the preferred embodiment, if the injector current does not reach the desired level IP and the edge triggerable latch 32 is not set, the one shot timer 38 will not retrigger. In addition, the high voltage switch 18 will be de-activated. If the fly-back voltage pulse, shown in FIG. 2 at the end of time duration Tpeak, is not present, latch 44 is reset by the output of one shot timer 38. All power delivered to the fuel injector 36 is turned off by a logic circuit which perform the functional output of an AND gate 34 delivering a low signal to switch 22 which in turn shuts off high side driver 25.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above mentioned description is to be considered exemplary, rather than limiting, and the true scope of the invention is that defined in the following claims.

What is claimed is:

1. An injector failure detection circuit including at least one injector having a high side and a low side terminal, the circuit comprising:

a one shot timer for transmitting a constant voltage state signal output when the injector reaches a set current threshold at a start of an injector current peak time duration;

a voltage sense comparator for transmitting a low voltage state signal output when the low side terminal of the injector produces a fly-back voltage pulse;

means for monitoring current of the injector during a rise time duration and the peak time duration, the current monitoring means in communication with the one shot timer;

means for disconnecting all electrical power supplied to the at least one injector if the injector current fails to reach a peak level during the rise time duration or the fly-back voltage pulse fails to occur at the end of the peak time duration, the disconnection means in communication with the one shot timer and the voltage sense comparator; and means for monitoring the fly-back voltage pulse produced by the low side terminal of the injector, the fly-back voltage monitoring means in communication with the injector.

2. The fuel injector failure detection circuit of claim 1 wherein the injector current monitoring means comprises:

a logic circuit having a functional equivalent output of an AND gate;

a first edge triggerable latch having at least one input and an output, the at least one input in communication with the voltage sense comparator and the logic circuit, the output in communication with the one shot timer, the latch output changing states given an active low at the at least one latch input;

the voltage sense comparator in communication with the injector power disconnection means;

the one shot timer in communication with the injector power disconnection means; and a second edge triggerable latch having at least one input and an output, internal to the injector power disconnection means, the latch set upon the occurrence of the fly-back voltage pulse, the latch output in communication with the logic circuit.

3. The fuel injector failure detection circuit of claim 2 wherein the injector fly-back voltage monitoring means comprises second edge triggerable latch having at least one input and an output, internal to the injector power disconnection means, the latch set upon the occurrence of the fly-back voltage pulse, the latch output in communication with the logic circuit.

4. The fuel injector failure detection circuit of claim 3 wherein the injector power disconnection means comprises:

the logic circuit having a functional equivalent output of an AND gate;

the first edge triggerable latch having at least one input and an output, the at least one input in communication with the voltage sense comparator and the logic circuit, the output in communication with the one shot timer, the latch output changing states given an active low at the at least one latch input; and the second edge triggerable latch having at least one input and an output, the latch output changing state twice at the end of the injector peak time duration given the occurrence of the fly-back voltage pulse.

5. The fuel injector failure detection circuit of claim 4 further including a high voltage power supply for increasing a voltage output level of a battery, the high voltage power supply in communication with the battery and the injector.

6. In a vehicle and associated fuel injector failure detection circuit, the vehicle having at least one combustion chamber, a battery, and at least one fuel injector having a high side and a low side terminal for introducing a fuel in the at least one combustion chamber, the fuel injector failure detection circuit comprising:

a one shot timer for transmitting a constant voltage state signal output when the fuel injector reaches a set current threshold at a start of an injector current peak time duration;

a voltage sense comparator for transmitting a low voltage state signal output when the low side terminal of the fuel injector produces a fly-back voltage pulse;

a logic circuit having a functional equivalent output of an AND gate;

an edge triggerable latch having at least one input and an output, internal to the injector power disconnection means, the latch having the at least one input in communication with the one shot timer, the latch output in communication with the logic circuit, the latch output changing state twice at the end of the injector peak time duration given the occurrence of the fly-back voltage pulse;

a fast transition circuit for speeding the de-energization of the fuel injector, the fast transition circuit in communication with the low side terminal of the fuel injector;

means for disconnecting all electrical power supplied to the at least one fuel injector if the injector current fails to reach a peak level during the rise time duration or the fly-back voltage pulse fails to occur at the end of the peak time duration, the disconnection means in communication with the one shot timer and the voltage sense comparator;

means for protecting the high side terminal of the fuel injector from a circuit anomaly, the high side protection means in communication with the injector disconnection means and the fuel injector; and means for protecting the low side terminal of the fuel injector from a circuit anomaly, the low side protection means in communication with the injector disconnection means, voltage sense comparator, and the fuel injector.

7. The fuel injector failure detection circuit of claim 6 wherein the injector power disconnection means comprises:

a logic circuit having a functional equivalent output of an AND gate;

a first edge triggerable latch having at least one input and an output, the at least one input in communication with the voltage sense comparator and the logic circuit, the output in communication with the one shot timer, the latch output changing states given an active low at the at least one latch input; and a second edge triggerable latch having at least one input and an output, the latch output changing state twice at the end of the injector peak time duration given the occurrence of the fly-back voltage pulse.

8. The fuel injector failure detection circuit of claim 7 further including a high voltage power supply for increasing a voltage output level of the vehicle battery, the high voltage power supply in communication with the vehicle battery and the fuel injector.

9. The fuel injector failure detection circuit of claim 8 wherein the high side protection means comprises a high voltage diode.

10. The fuel injector failure detection circuit of claim 9 wherein the low side protection means comprises a high voltage diode.

11. The fuel injector failure detection circuit of claim 8 wherein the high side protection means comprises a high side driver.

12. The fuel injector failure detection circuit of claim 11 wherein the low side protection means comprises a low side driver.

13. In a vehicle and associated fuel injector failure detection circuit, the vehicle having at least one combustion chamber, a battery, at least one fuel injector having a high side and a low side terminal for introducing a fuel in the at least one combustion chamber, and an Electronic Control Unit (ECU), the ECU including a microprocessor, memory capabilities, and at least one bus line, the fuel injector failure detection circuit comprising:

a high voltage power supply for increasing a voltage output level of the vehicle battery, the high voltage power supply in communication with the vehicle battery and the fuel injector;

a logic circuit having a functional equivalent output of an AND gate;

a voltage sense comparator for transmitting a low voltage state signal output when the low side terminal of the fuel injector produces a fly-back voltage pulse;

a first edge triggerable latch having at least one input and an output, the at least one input in communication with the voltage sense comparator and the logic circuit, the output in communication with the one shot timer, the latch output changing states given an active low at the at least one latch input;

a second edge triggerable latch having at least one input and an output, the at least one input in communication with the fly-back pulse detector, the time-out detector, and the first edge triggerable latch, the latch output changing state twice at the end of the injector peak time duration given the occurrence of the fly-back voltage pulse;

a one shot timer for transmitting a constant voltage state signal output when the fuel injector reaches a set current threshold at a start of an injector current peak time duration, the one shot timer in communication with the second edge triggerable latch;

a high side driver for protecting the high side terminal of the fuel injector from a high voltage, the high side driver in communication with the injector disconnection means and the fuel injector;

a low side driver for protecting the low side terminal of the fuel injector from a high voltage, the low side driver in communication with the low side terminal of the fuel injector, and the voltage sense comparator; and a fast transition circuit for speeding the de-energization of the fuel injector, the fast transition circuit in communication with the low side driver.

14. The fuel injector failure detection circuit of claim 13 further comprising an input signal conditioning circuit having at least one input and one output, the at least one input in communication with the ECU, and the at least one output in communication with the a logic circuit and the fast transition circuit, the input circuit for receiving a pulse signal from the ECU to commence operation of the fuel injector failure detection circuit.

15. The fuel injector failure detection circuit of claim 14 further comprising a high voltage switch having at least one input and at least one output, the at least one input in communication with the high voltage power supply and the one shot timer output, the at least one output in communication with the high side driver.

* * * * *